United States Patent [19]

Sagou

[11] Patent Number: 4,960,659

[45] Date of Patent: Oct. 2, 1990

[54] METHOD FOR PREPARING A SHADOW MASK FOR A COLOR PICTURE TUBE

[75] Inventor: Seiji Sagou, Saitama, Japan

[73] Assignee: Kabushiki Kaisha Toshiba, Kawasaki, Japan

[21] Appl. No.: 296,809

[22] Filed: Jan. 13, 1989

[30] Foreign Application Priority Data

Jan. 27, 1988 [JP] Japan ..... 63-014509

[51] Int. Cl.[5] ..... G03C 5/04

[52] U.S. Cl. ..... 430/23; 430/323; 430/394; 430/494; 313/402; 445/47

[58] Field of Search ..... 430/5, 394, 935, 23, 430/494, 323; 445/47; 313/402

[56] References Cited

U.S. PATENT DOCUMENTS 3,66,462 5/1972 Kaplan ..... 430/321 X 3,409,487 11/1968 Fry et al. ..... 430/323

FOREIGN PATENT DOCUMENTS 56-13298 3/1981 Japan .

57-60641 4/1982 Japan .

*Primary Examiner*—Jose Dees

*Attorney, Agent, or Firm*—Oblon, Spivak, McClelland, Maier & Neustadt

[57] ABSTRACT

A method for preparing a shadow mask with a plurality of apertures for a color picture tube from a metal shadow mask sheet includes the step of exposing the entire surface of the photosensitive layers provided on the both surfaces of the metal sheet to an unpatterned light before or after the step of exposing the photosensitive layers to patterned light in order to form resist films.

6 Claims, 4 Drawing Sheets

METHOD FOR PREPARING A SHADOW MASK FOR A COLOR PICTURE TUBE

BACKGROUND OF THE INVENTION

This invention relates to a shadow mask for a color picture tube, and more particularly, to a method for preparing the shadow mask.

A color picture tube, as shown in FIG. 1, generally comprises a glass envelope 1, in-line electron guns 3 emitting three electron beams 11R, 11G and 11B, and a phosphor screen 5 containing red, green and blue phosphor dots (not shown) which emit visible light when excited by the electron beams 11R, 11G and 11B. Electron guns 3 are located in a neck portion 2 of the envelope 1, while the phosphors, arranged in dotted shapes of cyclically repeating colors, are coated on the inner surface of the panel portion 4 of the envelope 1. Connecting neck portion 2 with the panel portion 4 is a funnel portion 12. The electron beams 11R, 11G and 11B are deflected by magnetic fields produced by a deflection yoke (not shown) surrounding a portion of the neck portion 2.

Near the screen 5 is a shadow mask 6 having a plurality of circular apertures 10 shown in FIG. 2 corresponding to the position of the phosphor dots. The shadow mask 6 is attached to a mask frame 7 supported within the envelope 1 by frame holders 8 which are releasably mounted on panel pins 9 embedded in side walls of the panel portion 4.

The shadow mask 6 has the function of causing the electron beams to accurately bombard the phosphor dots. Therefore, the sectionl shape of the apertures 10 is carefully designed. Namely, as shown in FIG. 2, to form the apertures 10, the shadow mask 6 has a front opening **13*a* facing toward the phosphor screen, a rear opening 13*b* facing toward the electron guns and an inner wall 13*c* connecting the front opening to the rear opening. The inner wall 13*c* has a most constricted portion 13*d* between the openings 13*a* and 13*b* to determine the spot size of the electron beam 11B** projected on the phosphor screen.

Further, to avoid undesirable bombardment of the electron beam 11B on the inner wall **13*c*, the front opening 13*a* is larger than the rear opening 13*b*, while the inner wall 13*c* is inclined. In the shadow mask, if the position between the front and rear openings 13*a* and 13*b* and size of the most constricted portion 13*d* are shifted from designed value, the amount of electron beam passing through aperture 10 will change and thus the picture quality will be deteriorated. Also, if the electron beams 11B, 11G and 11R bombard the inner wall 13*c***, the color purity of the picture will be deteriorated due to reflected electron beams.

This type of shadow mask has been manufactured by photolithography. A typical process for manufacturing the shadow mask is disclosed in U.S. Pat. No. 3,973,965. Namely, as shown in FIG. 3A, a pair of photosensitive layers 14 are formed on both surfaces of a strip-shaped metal sheet 15 by coating photosensitive resin liquid on both surfaces, after the surfaces have been washed and dried. A pair of negative films **16*a* and 16*b* having dot patterns of different sizes formed thereon, are put on the photosensitive layers 14. Then, the photosensitive layers 14 are exposed to light emitted from light sources 17 through the negative films 16*a* and 16*b*, respectively (FIG. 3B). Next, the exposed photosensitive layers 14 are developed. Then, the unexposed portions of the layers 14 are removed. Thus, a pair of resist films 18*a* and 18*b*, which are composed of dot-shaped opening patterns corresponding to the dot patterns of the negative films 16*a* and 16*b* are formed on the sheet 15 (FIG. 3C). The resist films 18*a* and 18*b*** are dried and baked to increase of the degree of corrosion resistance.

After this, an etching solution is sprayed on both surfaces of the sheet 15 to form the apertures 10. As a result of etching, large holes **19*a* growing from large openings 20*a* in the resist film 18*a* and small holes 19*b* growing from small openings 20*b* in the resist film 18*b* are linked to each other (FIG. 3D). The large openings 20*a* are larger than the small openings 20*b*. Finally, the resist films 18*a* and 18*b* are peeled off and removed from the surfaces (FIG. 3E**).

During the etching process mentioned above, lateral extensions **21*a* and 21*b* of the resist films 18*a* and 18*b* are inevitably formed because of the lateral etching beneath the resist films which accompanies the growth of the holes 19*a* and 19*b*, as shown in FIG. 4. In FIG. 4, the lateral extension 21*a* of width d results from the isotropic etching. The extension 21*a*** is destroyed and peeled off due to the pressure of spraying of the etching solution. Consequently, the configuration of the apertures is altered from the design configuration.

The lateral etching mentioned above is liable to occur in thick shadow masks, which are used when the shadow mask is required to have a high mechanical strength, for example, with flattered shadow masks. For instance, when the sheet thickness is increased to 0.3 mm from a thickness of 0.15 mm used for a normal shadow mask, the etching time increases approximately 3 times. Thus, the lateral etching progresses in proportion to the progress of etching. Consequently, the lateral extension of the resist film increases and, finaly it is peeled off.

Also, the lateral etching is liable to occur in a high-resolution color picture tube shadow mask having small-sized apertures and a smaller array pitch compared with ordinary shadow masks. Namely, since it is hard to circulate the etching solution in the aperture due to the small openings, the etching time increases compared with that of an ordinary shadow mask.

SUMMARY OF THE INVENTION

One object of this invention is to provide a method for preparing a shadow mask having small-sized apertures arranged with a small array pitch suitable for high-resolution color picture tubes.

Another object of the invention is to produce a shadow mask made of thick metal sheet having small apertures of accurate shape.

Still another object of the invention is to provide a method for preparing a shadow mask with a high reliability.

A further object of the invention is to prevent undesirable lateral etching from occuring during preparation of a shadow mask.

Therefore, the invention may provide a method for preparing a shadow mask having a plurality of apertures permitting the passage of electron beams emitted from an electron gun of a color picture tube from a metal shadow mask sheet, comprising the steps of: providing a first and a second photosensitive layers on first and second surfaces of the shadow mask sheet, respectively; forming a resist film on each of the first and second surfaces, at least one of the resist films having predetermined pattern of recesses; etching the sheet for removing a portion of each recess to form the apertures; and removing the remaining portions of the resist films.

The present inventor found that when the photosensitive layer was exposed to an unpatterned light before or after the exposure to the patterned light in order to form the resist film, the lateral etching could be greatly decreased.

According to the invention, the ratio of the accumulated exposure amount of the exposure to the unpatterned light to the accumulated exposure amount of the exposure to the patterned light is preferably about 10% to about 45%. When it becomes less than about 10%, the lateral etching is not effectively decreased. When exposure exceeds about 45%, the etching is not successfully completed, since the residual photosensitive film in the unexposed areas to the patterned light becomes too thick.

The accumulated exposure amount means an accumulated total energy per unit area of the photosensitive layer during duration of exposure time. Namely, the accumulated exposure amount is represented by following equation.

(Accumulated Exposure Amount) [mJ/cm$^2$]=(Illuminance) [mW]×(Exposure Time) [second]

The accumalated exposure amount can be adjusted to an appropriate value in accordance with the thickness and kind of material of the photosensitive layer, and transmissivity of the negative film.

When the photosensitive film was exposed to the unpatterned light in addition to the exposure to the patterned light, the unexposed areas were covered with a residual photosensitive film as residual portions of a resist film after the unexposed portions of the photosensitive film were removed for forming the resist film on the shadow mask sheet. As a result, the resist film composed of pattern of recesses was obtained. The periphery of the unexposed area was covered with the resist film of sufficient thickness to protect against etching. The residual protions of the resist film covering the unexposed areas was peeled off so as to etch those areas. Thickness of the residual portions was less than about 20% of that of the resist film. Preferably, the thickness was in the range from about 0.1 μm to about 1 μm.

To adjust the ratio of the accumulated exposure amount of the exposure to the unpatterned light to the accumulated exposure amount of the exposure to the patterned light, exposure duration of time and illuminance of the lights can be changed, respectively.

DETAILED DESCRIPTION OF THE PREFERRED EMBODIMENT

The preferred embodiment of the invention will be described with reference to the accompanying drawings.

Figure 1:
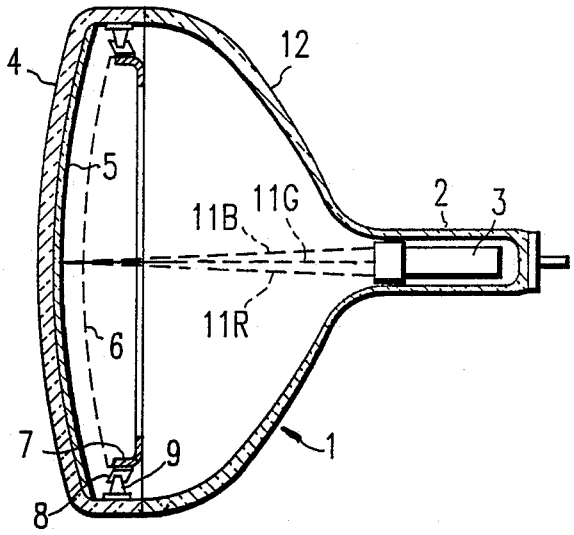
FIG. 1 is a sectional view of a color picture tube which may incorporate the present invention.
Figure 2:
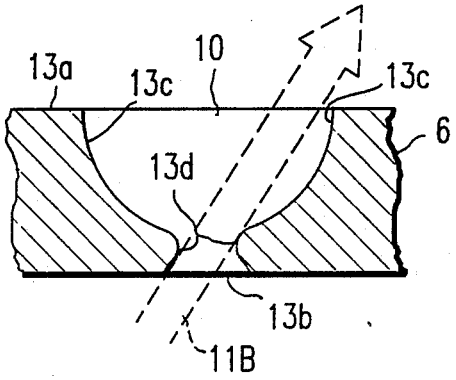
FIG. 2 is a sectional view of a shadow mask of the color picture tube shown in FIG. 1.
Figure 3A:
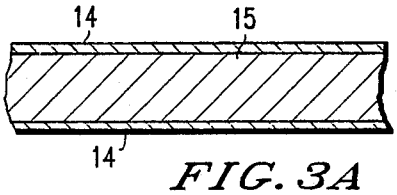
FIG. 3A PRIOR ART
FIGS. 3A to 3E are sectional views explaining the steps of preparing a shadow mask sheet with a plurality of apertures according to the conventional method.
Figure 3D:
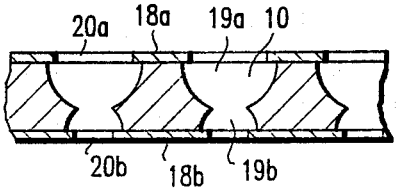
FIG. 3D PRIOR ART
Figure 3B:
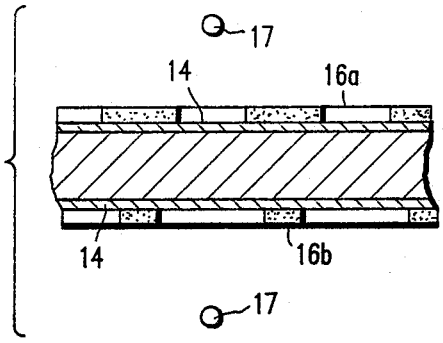
FIG. 3B PRIOR ART
Figure 3E:
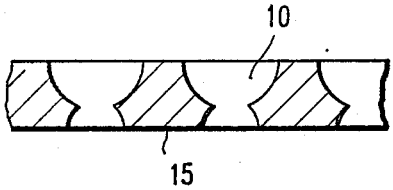
FIG. 3E PRIOR ART
Figure 3C:
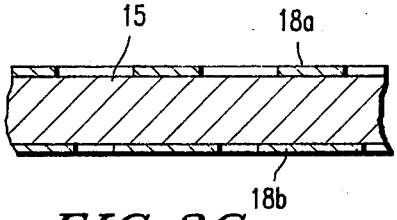
FIG. 3C PRIOR ART
Figure 4:
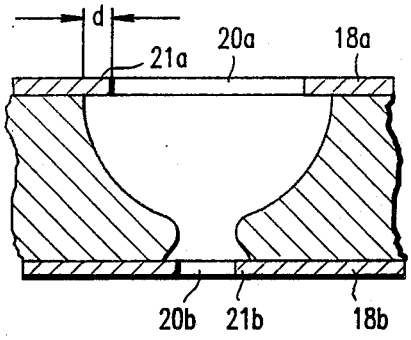
FIG. 4 PRIOR ART
FIG. 4 is a sectional view of the shadow mask shown in FIG. 3D.
Figure 5A:
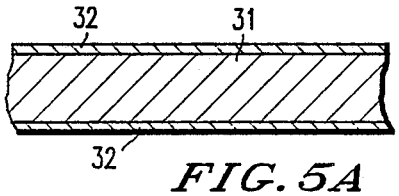
FIGS. 5A to 5F are sectional views explaining the steps of preparing a shadow mask sheet with a plurality of apertures according to the invention.

At first, strip-shaped metal sheet composed of, for example, aluminium-killed low carbon steel was washed on both surfaces. As shown in FIG. 5A, photosensitive layers 32 of thickness of approximately 6 μm were formed by coating and drying a photosensitive resin liquid on both surfaces of the metal sheet 31. As the photosensitive resin liquid, for example, an alkali milk caseinate including approximately 1 wt % of ammonium dichromate as a sensitizer, was used.

Figure 5D:
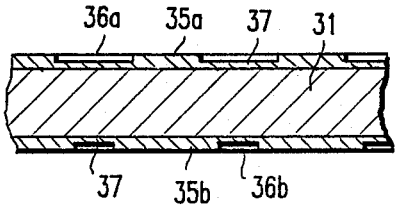
Figure 5B:
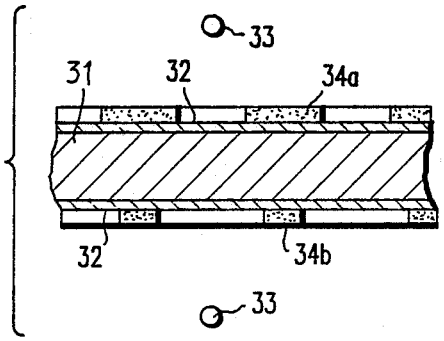

Next, as shown in FIG. 5B, the photosensitive layers 32 were simultaneously exposed to a light, such as ultraviolet, from light sources 33, respectively after a pair of negative films **34*a* and 34*b* were respectively applied to the photosensitive layers 32 to print the patterns of the negative films 34*a* and 34*b* on the photosensitive layers 32. The negative films 34*a* and 34*b* had different circular negative patterns. The first film 34*a* was formed with circular dot patterns so as to make large openings in one photosensitive layer 32. The second film 34*b* also was formed with circular dot patterns so as to make small openings in the other photosensitive layer 32. The light sources 33 were composed of 5 KW superhigh pressure mercury discharge lamps and they were positioned approximately 1 m from the surface of the metal sheet 31. The exposure was carried out for approximately 1 minute. As a result of the exposure, the photosensitive layers 32** were exposed by two kinds of patterned lights, respectively.

For adjusting the accumulated exposure amount, for example, an integrating exposure meter detecting the accumulated exposure amount was used. It, however, was difficult to detect the actual accumulated exposure amount at the surface of the photosensitive layer. The accumulated exposure amount at the surface of the negative film could be used for adjusting exposure of the photosensitive layer instead of the accumalated exposure amount at the surface of the photosensitive layer.

The exposure to the patterned light was executed till the exposed portions of the phtosensitive layer were solidified. In other words, the exposure was executed till the accumulated exposure amount reached the predetermined value.

Figure 5E:
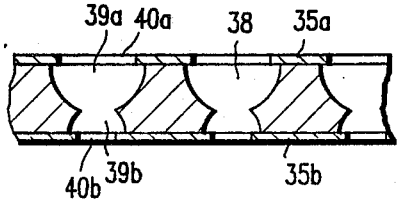
Figure 5C:
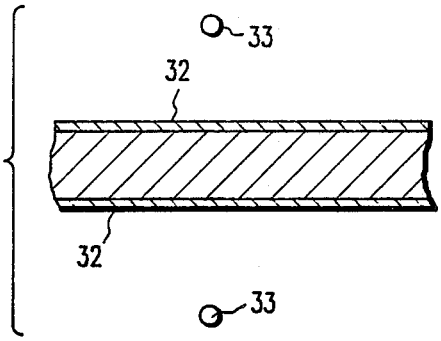

Further, as shown in FIG. 5C, the photosensitive layers 32 were exposed by the light from the light sources 33, additionally, after the negative films were removed for about 10 seconds. Namely, the photosensitive layers 32 were exposed by unpatterned light in addition to the exposure by the patterned light.

After the exposure, spraying by using warm water at about 40° C. and a pressure of about 1 kg/cm$^2$ was carried out to develop and remove the unexposed portions of the photosensitive layers 32. Then, the photoresistive layers 32 were dried in an atmosphere at a temperature of about 150° C. and burned in an atmosphere at a temperature of about 200° C. As the result of the steps mentioned above, as shown in FIG. 5D, a pair of resist films **35*a* and 35*b* having patterns of recesses with different sizes corresponding to the negative patterns of the negative films were obtained on the surfaces of the metal sheet 31. It should be noted that the unexposed areas 36***a* and 36*b*, which were not exposed by the patterned light, but exposed by the unpatterned light, were covered with thin film portions 37. In other words, the resist films 35*a* and 35*b* have different patterns of recesses having the residual portions 37 of the resist films 35*a* and 35*b*.

Next, the metal sheet covered with the resist films 35*a* and 35*b* was sprayed with ferric chloride solution at a temperature of about 67° C. for etching. The specific gravity of the solution was about 1.467. As shown in FIG. 5E, specified apertures were formed by linking large holes 39*a* to small holes 39*b*. The large and small holes 39*a* and 39*b* grew from the large openings 40*a* and the small openings 40*b* in the resist films 35*a* and 35*b*, respectively, during etching.

Figure 5F:
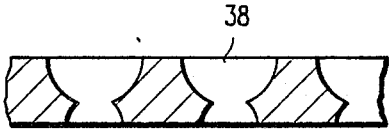

Finally, resist films 35*a* and 35*b* were removed by spraying a 15% solution of caustic soda at a temperature of about 90° C. and a pressure of about 1 kg/cm$^2$ after washing by water, and then the resultant shadow mask sheet with a plurality of apertures 38 shown in FIG. 5F was obtained by washing with water and drying.

Figure 6A:
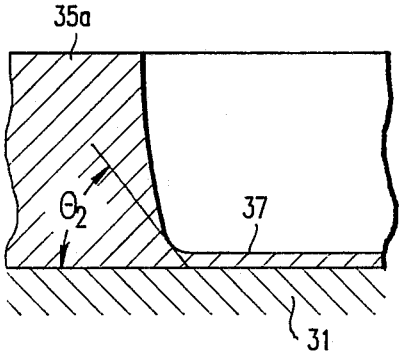
FIG. 6A is an enlarged sectional view of a portion of the photosensitive film formed on a metal sheet according to the invention and FIG. 6B is a similar sectional view of a photosensitive film formed on the metal sheet according to the conventional method.

According to the embodiment, since the photosensitive layer was exposed by the unpatterned light for a short duration of time, a thin photoresist layer still remained on the unexposed areas of the photosensitive layer exposed by the patterned light. Consequently, as shown in FIG. 6A, the resist film 35*a* has the thin film portions 37 covering the areas unexposed by the patterned light. The residual film portions 37 of the resist film 35*a* were so thin that the etching solution could penetrate through, and could be removed during etching. Consequently, the lateral etching underneath the resist film was decreased.

Figure 6B:
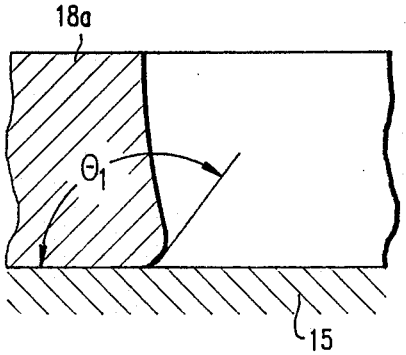
FIG. 6B PRIOR ART

On the contrary, in the case of the conventional method without exposure by the unpatterned light, the periphery of the resist film 18*a* surrounding the unexposed area by the patterned light was removed, as shown in FIG. 6B. Due to the removal, an edge portion of the resist film 18*a* formed an obtuse angle as shown by $\theta_1$. Consequently, since the etching solution penetrated to the edge portion, the lateral etching was promoted, undesirably. In the case of the embodiment of the invention, since the edge portion of the resist films 35*a* could be kept an acute angle $\theta_2$ even if the residual film portions 37 of the resist films 35*a* were removed, penetration of the etching solution could be prevented. Consequently, the lateral etching could be decreased.

Figure 7:
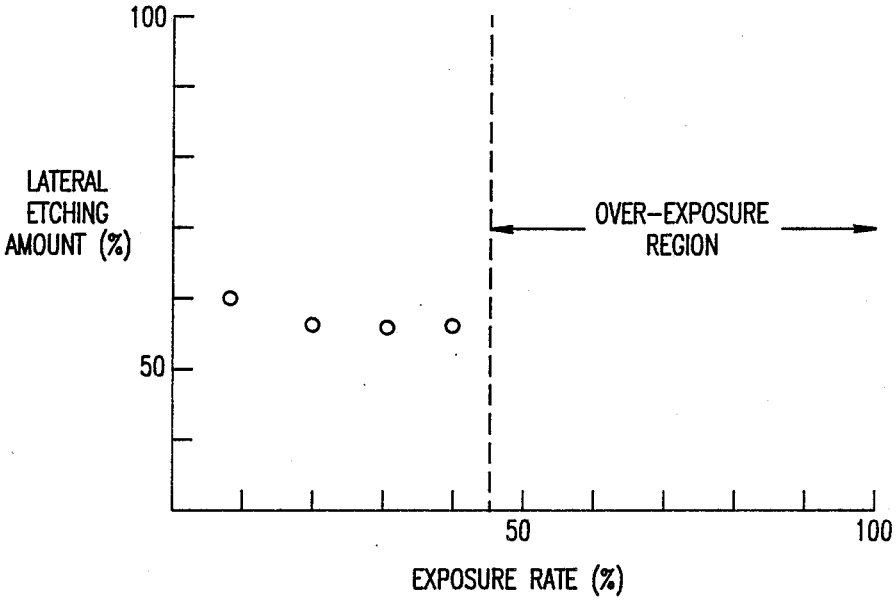
FIG. 7 is a graph showing the relationship between lateral etching amount and exposure rate.

FIG. 7 shows the relationship between the exposure amount of unpatterned light and the amount of the lateral etching. In this graph, the horizontal axis indicates the ratio(%) of the accumulated amount of exposure for the accumulated amount of exposure by the unpatterned light to the amount of exposure required for patterning by using negative films in close contact to the metal sheet. In other words, the ratio(%) is obtained by dividing the accumulated amount of exposure of the unpatterned light by the accumulated amount of exposure of the patterned light which is required for patterning. The vertical axis indicates the ratio(%) of the amount of the lateral etching when exposed to the unpatterned light, taking as 100% the amount of the lateral etching when exposed to the patterned light alone.

As seen from the graph, the ratio of the exposure amount of the unpatterned light to the exposure amount of the patterned light preferably ranges from about 10% to about 45%.

According to the invention, the length of the lateral extension of the photosensitive film was decreased to about 25% to about 45% of the thickness of the metal sheet due to the exposure by unpatterned light, while, the length of the lateral extension of the photosensitive film was 45% to 65% of the thickness of the metal sheet in the case of the conventional method shown in FIGS. 3A to 3E.

Further, the invention can prevent the metal sheet from rusting due to the residual photosensitive layer on the unexposed areas.

In the method of this invention, the exposure of the unpatterned light may be executed before or after the exposure of the patterned light. In addition, the exposure of the unpatterned light can be executed for one of the photosensitive layers, especially, for the photosensitive layer forming the larger opening pattern, or both photosensitive layers.

In the method of the invention, thickness of the first and second photosensitive layers can be made be different each other for preparing the shadow mask of a high resolution color picture tube. Namely, it is preferable to increase its thickness for the first photosensitive layer formed on the first surface of the metal sheet, in which large apertures are formed, compared with the second photosensitive layer. In this case, an accumulated exposure amount of the exposure to the first patterned light exposing the first photosensitive layer is adjusted to be larger than that of the exposure to the second patterned light. As previously mentioned, illuminance of the exposure light and/or duration of exposure time are increased for increasing the accumulated exposure amount.

The invention is applicable for the method shown in U.S. Pat. No. 4,689,114 (European Patent Application No. 137,366) which is effective for forming small apertures, to reduce the lateral etching.

What is claimed is:

1. A method for preparing a shadow mask having a plurality of apertures permitting the passage of electron beams emitted from an electron gun of a color picture tube from a metal shadow mask sheet, comprising the steps of:

providing a first and second photosensitive layers on first and second surfaces of the shadow mask sheet, respectively;

exposing the first photosensitive layer on the first surface of the sheet to a first patterned light and the second photosensitive layer on the second surface of the sheet to a second patterned light, the exposing being executed till respective accumulated exposure amount of the exposure to the first and second patterned light reaches predetermined value, exposing the entire surface of at least one of the first and second photosensitive layers to an unpatterned light, the exposing being executed till the accumulated exposure amount of the exposure to the unpatterned light reaches prescribed value smaller than the predetermined value, and removing portions of the first and second photosensitive layers unexposed by the first and second patterned light to leave resist films on the first and second surfaces, respectively;

etching the sheet for removing a portion of each recess to form the apertures; and removing the remaining portions of the resist films.

2. The method for preparing the shadow mask according to claim 1, wherein the ratio of the accumulated exposure amount of the exposure to the unpatterned light to the accumulated exposure amount of the exposure to the patterned light ranges from about 10% to about 45%.

3. A method for preparing a shadow mask having a plurality of apertures permitting the passage of electron beams emitted from an electron gun of a color picture tube from a metal shadow mask sheet, comprising the steps of:

providing a first and second photosensitive layers on first and second surfaces of the shadow mask sheet, respectively;

exposing the first photosensitive layer on the first surface of the sheet to a first patterned light of a prescribed illuminance for a first duration of time and the second photosensitive layer on the second surface of the sheet to a second patterned light of the prescribed illuminance for the first duration of time, exposing the entire surface of at least one of the first and second photosensitive layers to an unpatterned light of a predetermined illuminance for a second duration of time shorter than the first duration, and removing portions of the first and second photosensitive layers unexposed by the first and second patterned light to leave resist films on the first and second surfaces respectively;

etching the sheet for removing a portion of each recess to form the apertures; and removing the remaining portions of the resist films.

4. A method for preparing a shadow mask having a plurality of apertures permitting the passage of electron beams emitted from an electron gun of a color picture tube from a metal shadow mask sheet, comprising the steps of:

providing a first and second photosensitive layers on first and second surfaces of the shadow mask sheet, respectively;

exposing the entire surface of at least one of the first and second photosensitive layers to an unpatterned light, the exposing being executed till the accumulated exposure amount of the exposure to the unpatterned light reaches predetermined valued, exposing the first photosensitive layer on the first surface of the sheet to a first patterned light and the second photosensitive layer on the second surface of the sheet to a second patterned light, the exposing being executed till respective accumulated exposure amount of the exposure to the first and second patterned light reaches prescribed value larger than the predetermined value, and removing portions of the first and second photosensitive layers unexposed by the first and second patterned light to leave resist films on the first and second surfaces, respectively;

etching the sheet for removing a portion of each recess to form the apertures; and removing the remaining portions of the resist films.

5. The method for preparing the shadow mask according to claim 4, wherein the ratio of the accumulated exposure amount of the unpatterned light to the accumulated exposure amount of the patterned light ranges from about 10% to about 45%.

6. A method for preparing a shadow mask having a plurality of apertures permitting the passage of electron beams emitted from an electron gun of a color picture tube from a metal shadow mask sheet, comprising the steps of:

providing a first and second photosensitive layers on first and second surfaces of the shadow mask sheet, respectively;

exposing the entire surface of at least one of the first and second photosensitive layers to an unpatterned light of a predetermined intensity for a first duration of time, exposing the first photosensitive layer on the first surface of the sheet to a first patterned light of a prescribed intensity for a second duration of time longer than the first duration of time and the second photosensitive layer on the second surface of the sheet to a second patterned light of the prescribed intensity for the second duration of time, and removing portions of the first and second photosensitive layers unexposed by the first and second patterned light to leave resist films on the first and second surfaces, respectively;

etching the sheet for removing a portion of each recess to form the apertures; and removing the remaining portions of the resist films.

* * * * *